US006581927B2

(12) United States Patent
Claudio

(10) Patent No.: US 6,581,927 B2
(45) Date of Patent: Jun. 24, 2003

(54) DEVICE FOR SEPARATING GROUPS OF SHEETS IN AN APPARATUS FOR FORMING AND BANDING GROUPS OF SHEETS, SUCH AS BANKNOTES

(75) Inventor: Rossi Claudio, Bologna (IT)

(73) Assignee: CAT Systems S.r.l., Bologna (IT)

( * ) Notice: Subject to any disclaimer, the term of this patent is extended or adjusted under 35 U.S.C. 154(b) by 5 days.

(21) Appl. No.: 09/910,167

(22) Filed: Jul. 20, 2001

(65) Prior Publication Data

US 2002/0060406 A1 May 23, 2002

(30) Foreign Application Priority Data

Jul. 31, 2000 (IT) ..... BO2000A0475

(51) Int. Cl.[7] ..... B65H 29/40; B65H 39/10
(52) U.S. Cl. ..... 271/187; 271/213; 271/315
(58) Field of Search ..... 271/213, 207, 271/315, 187, 218; 414/790.8

(56) References Cited

U.S. PATENT DOCUMENTS 4,511,136 A * 4/1985 Yamada et al. ..... 271/187
4,595,193 A * 6/1986 Nakamura ..... 271/187
5,040,783 A * 8/1991 Ruehl ..... 271/187
5,150,168 A * 9/1992 Kamath et al. ..... 271/218
5,421,700 A * 6/1995 Kranz ..... 271/315
5,713,283 A * 2/1998 Eltner et al. ..... 271/218
6,019,209 A * 2/2000 Hara et al. ..... 271/315
6,276,678 B1 * 8/2001 Nottelmann et al. ..... 271/315

* cited by examiner

*Primary Examiner*—John M. Jillions
(74) *Attorney, Agent, or Firm*—Fay, Sharpe, Fagan, Minnich & McKee, LLP

(57) ABSTRACT

A device for separating groups of sheets may be used on an apparatus for forming and banding groups of sheets comprising at least one track to feed the individual sheets to a pick up roller for the individual sheets arriving and to transfer said sheets to a stacking channel, extending along a stacking axis, where the sheets are placed on top of one another in stacks which may be preset and banded, one after another. The device comprises a partial support element for the sheets transferred, which operates between the roller and the channel and is mobile, by means synchronized with the roller, between an operating separation position, in which the element is partially inside the dimensions of the roller, intercepting a portion of a first sheet in a stack to be formed, and a release position, in which the element is outside the dimensions of the roller and close to the mouth of the channel, partially supporting a corresponding presettable stack of sheets fed from the roller.

18 Claims, 5 Drawing Sheets

DEVICE FOR SEPARATING GROUPS OF SHEETS IN AN APPARATUS FOR FORMING AND BANDING GROUPS OF SHEETS, SUCH AS BANKNOTES

BACKGROUND OF THE INVENTION

The present invention relates to a device for separating groups of sheets in an apparatus for forming and banding groups of sheets, such as banknotes.

The present invention clearly refers to an apparatus for the formation of groups or bundles of banknotes, in order to simplify the description, but without limiting the scope of application of the present invention.

At present, the above-mentioned apparatuses for checking and forming groups of banknotes normally comprise a series of stations, located one next to another and structurally similar, for forming groups of banknotes, consisting of a set of tracks for feeding the individual banknotes (selected upstream according to size, quality and type by special means) and a unit which positions and stacks the groups of banknotes in an outfeed channel, where a device which picks up and bands the group of banknotes formed operates, creating a bundle consisting of a preset number of banknotes.

Each positioning unit consists of a roller which picks up the individual banknotes from the relative channel and transfers the banknotes to the infeed of the forming channel, from which, after a preset number, they are picked up by the pick up and banding device for application of the band and subsequent transfer to a preset stacking zone for the banded bundles either inside the same apparatus or in another appropriate site.

However, such operating units have substantially different operating times, that is to say, the banknote feed tracks and the transfer roller operate at speeds which are higher than those of the pick up and banding device. This limits the overall output of the apparatus, since several tracks and rollers must be used in an alternative fashion, whilst a banding operation is performed in one of the adjacent channels. Basically, channel feed is interrupted in an alternating fashion with the activation of the relative banding device, thus reducing the production capacity of the entire apparatus.

SUMMARY OF THE INVENTION

The aim of the present invention is, therefore, to overcome the above-mentioned disadvantage by providing a device for separating groups of sheets in an apparatus for forming and banding groups of banknotes, designed to allow an increase in the speed and productivity of the apparatus without excessively modifying the structure of the various units present.

BRIEF DESCRIPTION OF THE DRAWINGS

The technical features of the present invention, in accordance with the above-mentioned aims, are set out in the claims herein and the advantages more clearly illustrated in the detailed description which follows, with reference to the accompanying drawings, which illustrate a preferred embodiment without limiting the scope of application, and in which:

DESCRIPTION OF THE PREFERRED EMBODIMENTS

Figure 1:
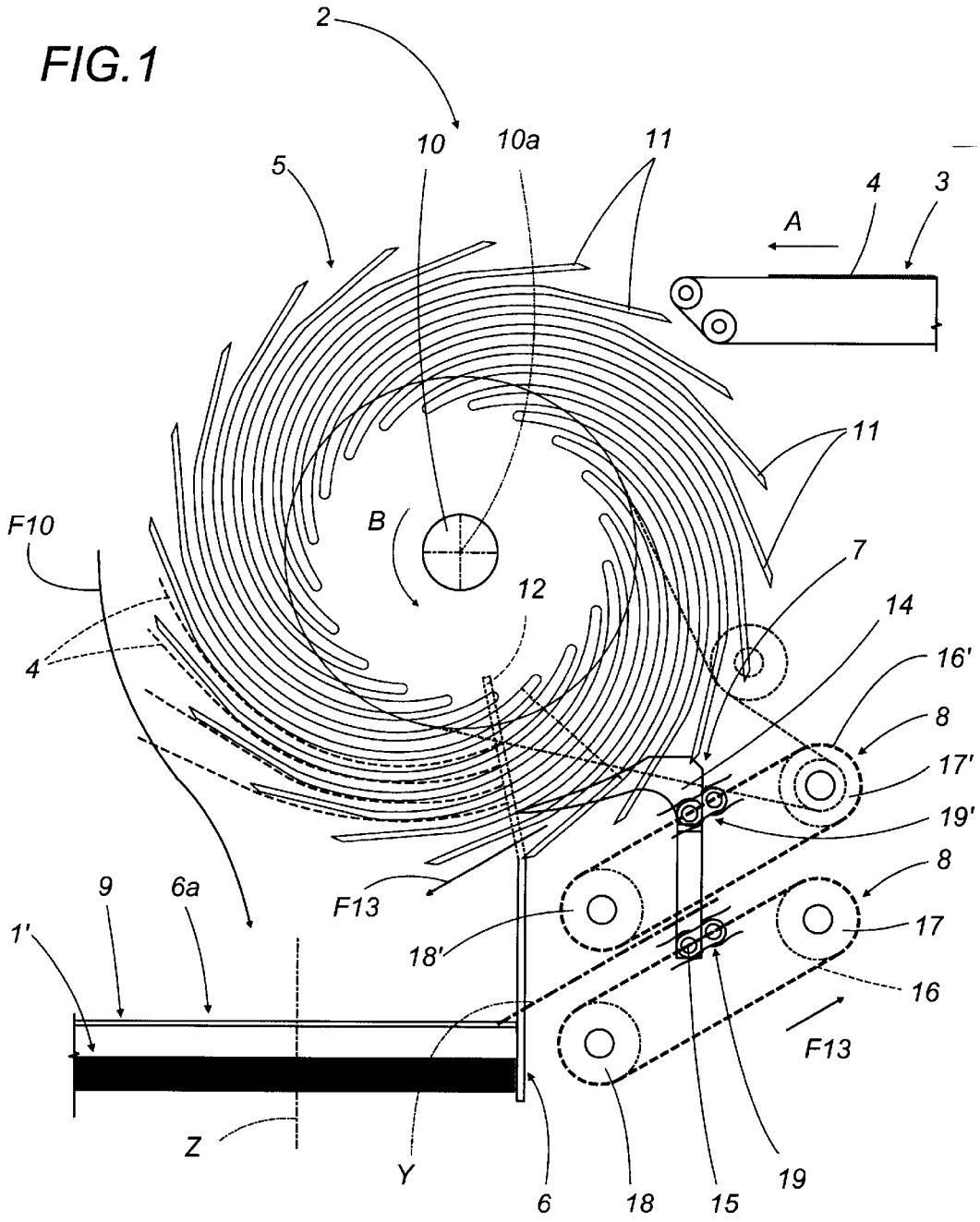
FIG. 1 is a schematic front view, with some parts cut away to better illustrate others, of part of an apparatus for forming and banding sheets, equipped with a device made according to the present invention for separating groups of sheets, shown in a first operating configuration.
Figure 2:
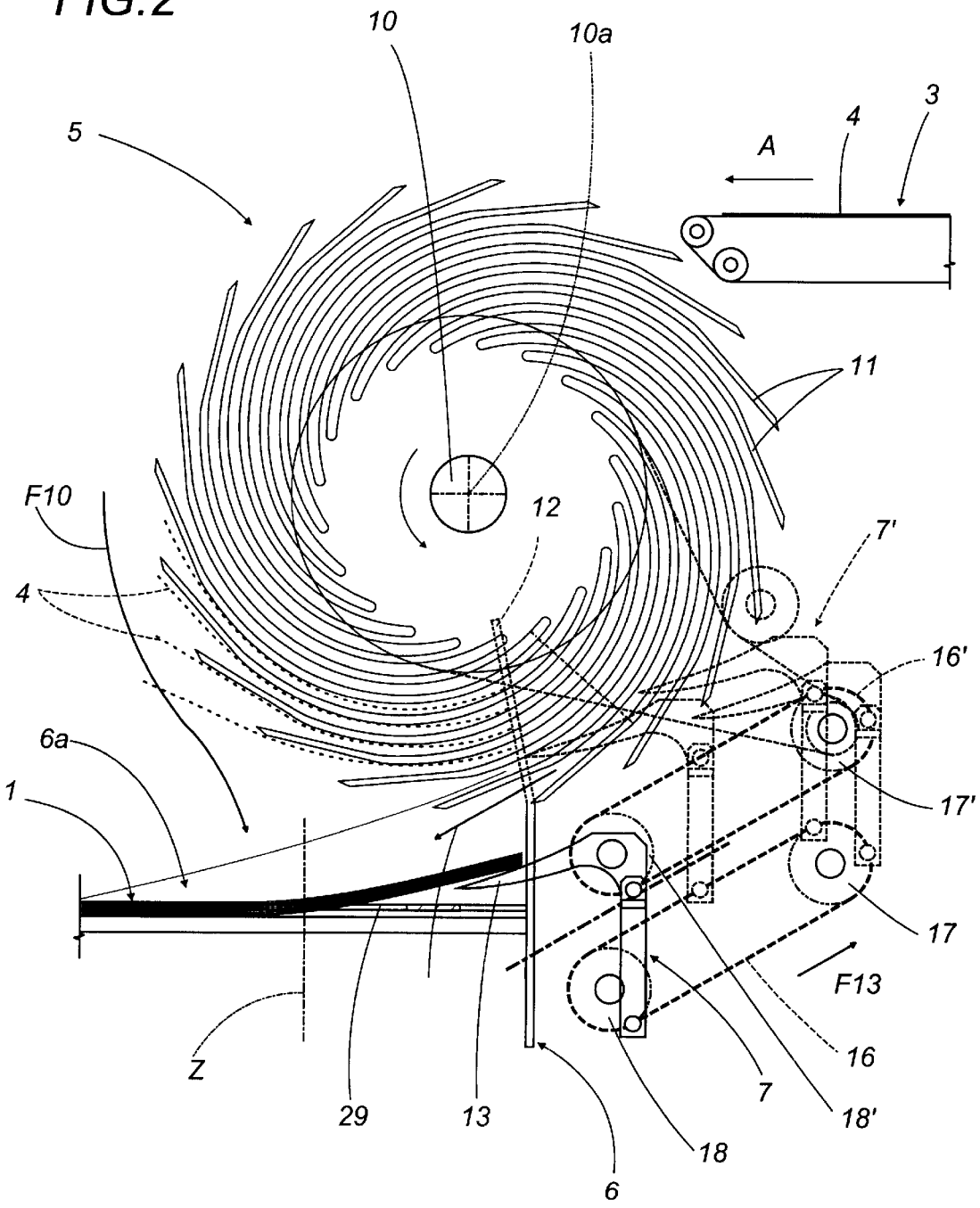
FIG. 2 is a schematic front view with some parts cut away, of part of the apparatus illustrated in FIG. 1, with the device made in accordance with the present invention in a second operating configuration.

With reference to the accompanying drawings, and in particular FIGS. 1 and 2, the device disclosed may be used for separating groups 1 of sheets in an apparatus 2 for forming and banding these groups 1 of sheets which, by way of example and without limiting the scope of application of the invention, may be banknotes.

The apparatus 2 on which the device disclosed may be fitted comprises a track 3 which feeds the individual sheets 4 or banknotes (in direction A) to a pick up roller 5 for the individual sheets 4 arriving and which transfers the sheets 4 to a stacking channel 6 (with direction of rotation B), extending along a stacking axis Z, where the sheets 4 are placed one on top of another in stacks 1 which may be preset and banded, one after another.

In this description, for clarity, reference is made to individual elements which constitute the apparatus 2 (track 3, roller 5, channel 6), but the apparatus 2 may have a plurality of these elements forming adjacent modules, without limiting the scope of the inventive concept.

As illustrated in FIGS. 1 and 2, the roller 5 consists of a hub 10 which rotates about an axis 10*a*, driven by known drive means (not illustrated, being of the known type and not part of the subject matter of the present invention).

The roller 5 has a plurality of flexible first radial plates 11, designed to pick up a single sheet 4, arriving from the track 3, rotate through approximately 180° (see arrow F10) and transfer it to the mouth 6*a* of the channel 6, where the sheets 4 are stacked on top of one another thanks to contact between one end of the sheet and a fixed contact wall 12 located within the roller 5 dimensions.

The device disclosed basically comprises an element 7 for partially supporting the sheets 4 transferred, operating between the roller 5 and the channel 6, and mobile, thanks to means 8 synchronized with the roller 5, between an operating separation position (see FIG. 1), in which the element 7 is partially within the dimensions of the roller 5, intercepting part of a first sheet 4 of a stack 1 to be formed, and a release position (see FIG. 2), in which the element 7 is outside the dimensions of the roller 5 and close to the mouth 6*a* of the channel 6, partially supporting a corresponding presettable stack 1 of sheets 4 fed from the roller 5.

In addition, the device comprises means 9 for temporarily supporting the presettable stack 1, located close to the mouth 6*a* of the channel 6, being mobile along a surface parallel with the sheets 4 transferred and stacked, and operating at least when the partial support element 7 is in the release position.

Figure 5:
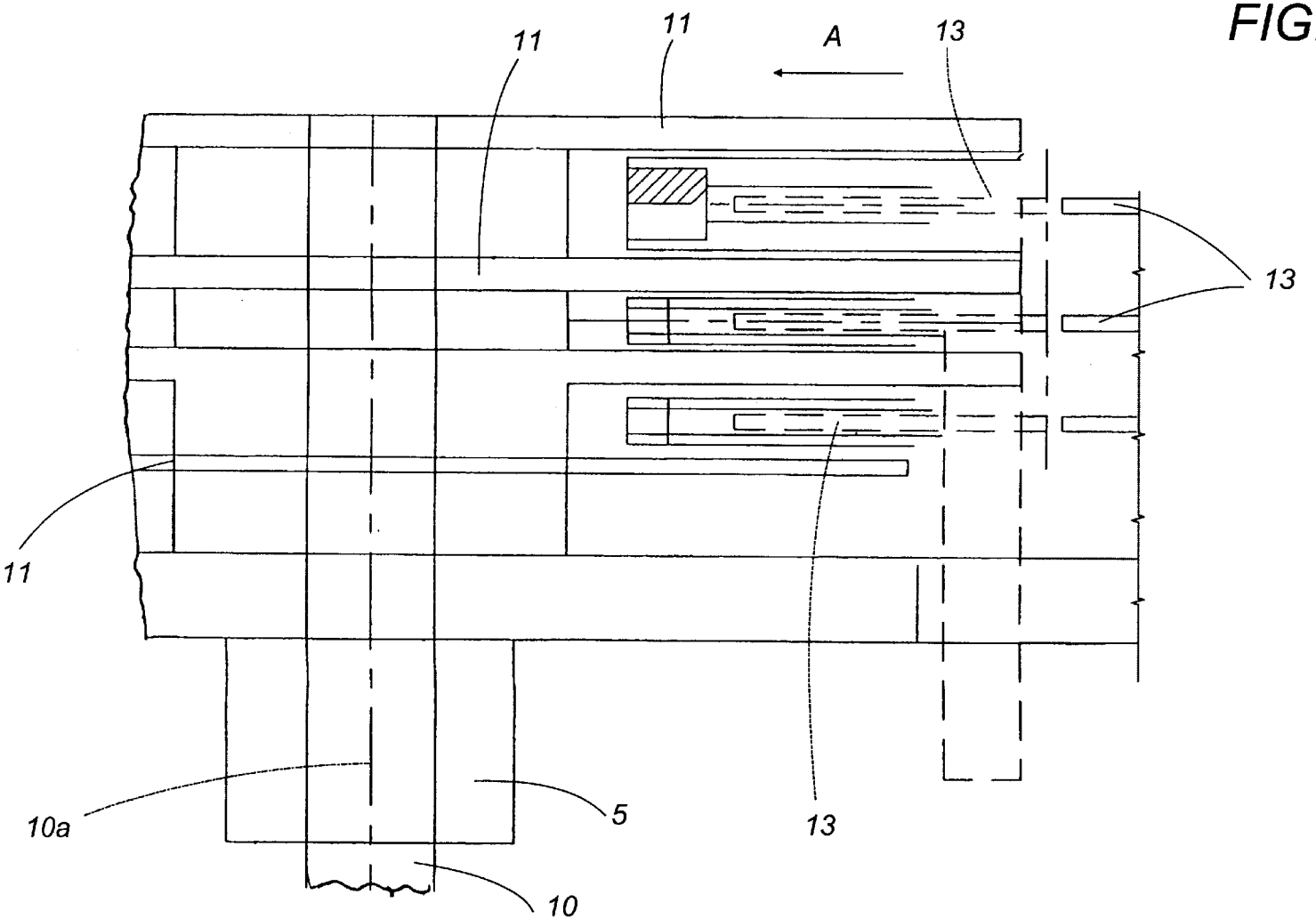
FIG. 5 is a schematic top plan view with some parts cut away to better illustrate others, of part of the apparatus illustrated in the previous figures and the device made in accordance with the present invention.

More specifically with reference to the technical details, the partial support element 7 comprises a plurality of second plates 13, forming a fork, which engage with the first plates 11 of the roller 5, at least when the element 7 is in the operating separation position (see FIG. 5 in particular).

As illustrated in FIG. 1, the free end of the second plates 13, in the operating position, substantially coincides with the fixed contact wall 12. The second plates 13 are beak-shaped, so that, starting with the operating separation position and until the entire element 7 exits the dimensions of the roller 5, they are inserted in the space between two consecutive first plates 11, allowing the partial support of the sheets 4 which will form a stack 1, when the sheets reach the zone in which the fixed wall 12 is located.

Structurally, the partial support element 7 comprises the above-mentioned fork portion consisting of the beak-shaped second plates 13, which consist of a single body with a fixed end support 14, in turn attached to a shaft 15 connected to the means 8 which synchronize its motion with the roller 5.

In a first embodiment, the drive means 8 of the partial support element 7 may comprise two parallel chains 16, 16', each forming a loop around pairs of toothed wheels 17, 18 and 17', 18' and located close to the channel 6, forming a kind of four-bar linkage.

A pair of links 19, 19' in the pair of chains 16, 16' is attached to the shaft 15, parallel with the stacking axis Z, to allow a cyclic looped path for the partial support element 7, synchronized with the roller 5, and respectively divided into a first operating part, along an axis Y which is set at an angle to the stacking axis Z, between the operating separation position and the release position, and a second, non-operating part, opposite to the previous one and substantially outside the dimensions of the channel 6 and the roller 5, for returning to the operating release position.

Figure 4:
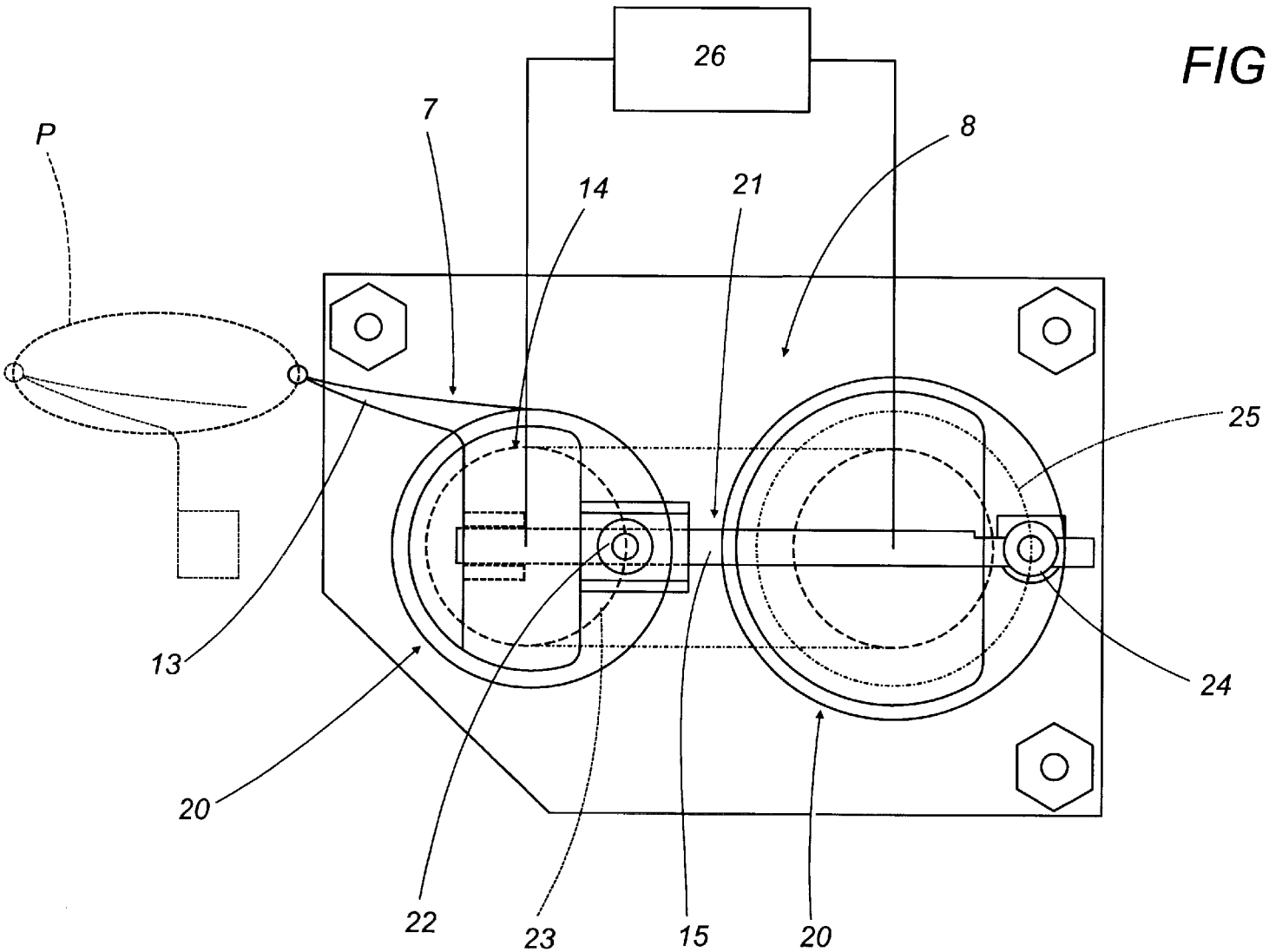
FIG. 4 is a schematic front view with some parts cut away to better illustrate others, of an alternative embodiment of the device made in accordance with the present invention.

FIG. 4 illustrates an alternative embodiment of the above-mentioned drive means 8 for the partial support element 7. In this case, the means 8 consists of cam means 20 designed to allow a cyclical looped path P for the support element 7 comprising the operating separation position and release position.

In greater detail, the cam means 20 may comprise a connecting rod unit 21 consisting of a first cam element 22, attached to the partial support element 7, which slides along a circular track 23 and is fixed to one end of the support shaft 15 which is part of the partial support element 7.

The opposite end of the shaft 15 is controlled by a second cam element 24 moved, on its axis by cam means 26 synchronized with the pick up and transfer roller 5 (these means are illustrated with a simple block, being of the known type). Said cam means 20 may take various forms. The one illustrated is just one of the many possible embodiments and does not limit the other types.

The above-mentioned temporary support means 9 comprise (see FIG. 3 in particular) a mobile, that is to say, rotating plate 27, which turns along the surface parallel with the sheets 4 stacked, driven by means 28 schematically illustrated with a block, between a non-operating position (shown with a continuous line), in which the plate 27 is distanced from the mouth 6*a* of the channel 6, and a position in which it is at the mouth 6*a* of the channel 6 (shown with a dashed line) at least when the partial support element 7 is in the release position, forming a surface which temporarily supports and divides the stack 1 of sheets being formed from a stack 1' previously formed.

The plate 27 may consist of a first, operating portion 27*a*, projecting from a slit 29 which may be made on one side of the channel 6 (either front or side) at the operating position, and a second, connecting portion 27*b*, with drive means 28.

Figure 3:
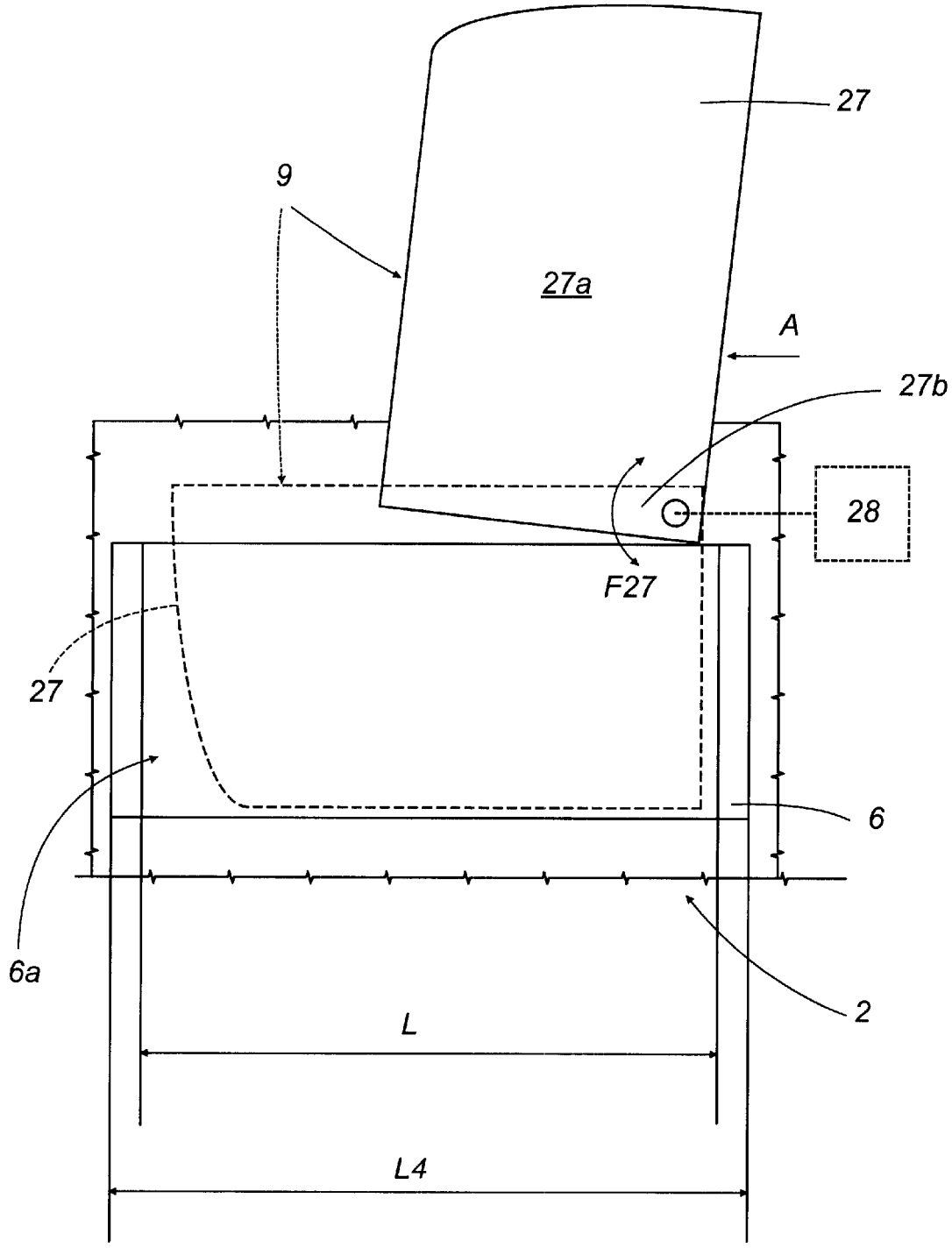
FIG. 3 is a schematic top plan view with some parts cut away, of part of the apparatus illustrated in the previous figures and a detail of part of the device made in accordance with the present invention.

As illustrated in FIGS. 2 and 3, the length L of the first, operating portion 27*a* and the slit 29 is less than the length L4 of the sheets 4. In this way, when the plate 27 exits the channel 6 (see arrow F27 in FIG. 3), during stack 1 formation, it does not cause any sheets to exit the channel 6 and allows the stack 1 to be picked up by a known pick up and banding device (not illustrated here), then deposited in an appropriate seat.

The device structured in this way functions as follows. Starting with an apparatus cycle start situation and with the element 7 in the operating separation position (see FIG. 1) and the plate 27 in the operating position at the mouth 6*a* of the channel 6.

Activation of the apparatus 2 causes the arrival of sheets 4 on the track 3 in the direction A, with the pick up of the individual sheets 4 by first plates 11 and sheet transfer to the channel 6.

When the first sheet 4 of a stack 1 arrives at the contact wall 12, the sheet 4 is already supported by the second plates 13 which, at this point and thanks to the means 8, begin a downstroke towards the mouth 6*a* of the channel 6 (see arrow F13 in FIGS. 1 and 2), thus partially supporting the successive sheets 4 which gradually overlap the first sheet 4, moving further towards the channel 6.

When the stack is practically separate, the element 7 begins covering the non-operating portion of the path, opposite to the one previously covered (see arrow F13*a* in FIGS. 1 and 2), leaving the ready-formed stack 1 on the plate 27.

As soon as the element 7 leaves the channel 6 and, therefore, no longer interferes with the sheets 4 in the stack 1, the plate 27 can turn outwards, following the start of a new cycle by the element 7, allowing stack 1 downfeed into the channel 6 and subsequent stack 1 pick up by the sheet 4 banding device.

Obviously, since the apparatus normally has several channels and transfer rollers, the element 7 separating cycles for the various channels 6 may be alternated, that is to say, when one finishes separating a stack 1 and is returning to the operating position, another track 3 feeds sheets 4 to a roller 5 with the element 7 for forming a stack 1, or cycles may be simultaneous.

The device structured in this way, therefore, achieves the above-mentioned aims by simply inserting a temporary support and separating element which also avoids the need to alternate the outfeed on the tracks to alternate between rollers for the sheet transfer.

In other words, the device made in accordance with the present invention provides continuous feed to the rollers, thanks to the fact that the speed at which the stack is created is controlled both by the partial support element and by the separating plate 7.

The invention described can be subject to modifications and variations without thereby departing from the scope of the inventive concept. Moreover, all the details of the invention may be substituted by technically equivalent elements.

What is claimed:

1. A device for separating groups of sheets in an apparatus for forming and banding groups of sheets, the apparatus being of the type with at least one track for feeding the individual sheets to a roller which picks up the individual sheets in arrival and transfers the sheets to a stacking channel that extends along a stacking axis and wherein the sheets are placed one on top of another in stacks which can be preset and banded, one after another, the separating device comprising an element for partial support of the sheets transferred, operating between the roller and the channel and mobile, by means synchronized with the roller, between an operating separation position, in which the element is partially inside the dimension of the roller, intercepting part of a first sheet of a stack to be formed, and a release position, in which the element is outside the dimensions of the roller and close to the mouth of the channel, partially supporting a pre-settable stack of sheets fed from the roller.

2. The device according to claim 1, comprising temporary support means for the presettable stack, close to the mouth of the channel, said means being mobile along a surface parallel with the sheets transferred and stacked and operating at least when the partial support element is in the release position.

3. The device according to claim 1, where the roller consists of a hub which rotates about an axis and has a plurality of first radial plates designed to pick up a single sheet and transfer it to the mouth of the channel in conjunction with a fixed wall which makes contact with one end of the sheet, and wherein the partial support element comprises a plurality of second plates forming a fork and designed to engage with the first plates of the roller, at least when the element is in the operating separation position, and in which the free end of the second plates substantially coincides with the fixed contact wall; the second plates being beak-shaped so that, at least from the operating separation position to the point at which the element exits the dimensions of the roller, they are inserted in the gap between two consecutive first plates, allowing partial support of the sheets of a stack to be formed.

4. The device according to claim 1, wherein the partial support element comprises a fork-shaped portion consisting of the second plates in the form of a single body with a fixed end support, the latter being attached to a support connected to the drive means synchronized with the roller.

5. The device according to claim 1, wherein the partial support element drive means comprise a pair of chains, each looped over pairs of toothed wheels and parallel with one another, forming a kind of four-bar linkage, and close to the channel; at least one pair of links in the pair of chains being attached to the shaft, parallel with the stacking axis, allowing a cyclical loop path for the partial support element, in time with the roller and respectively divided into a first, operation part, along an axis set at an angle to the stacking position and the release position, and a second, non-operating part, opposite to the previous one and substantially outside the dimensions of the channel and the roller.

6. The device according to claim 1, wherein the partial support element drive means comprise cam means designed to allow a cyclical looped path for the partial support element, comprising said operating separation position and release position.

7. The device according to claim 6, wherein the cam means comprise a connecting rod unit consisting of a first cam element, which is attached to the partial support element, is mobile on a first circular path and is attached to one end of the shaft forming part of the partial support element; the opposite end of the shaft being controlled by a second cam element driven by cam means synchronized with the pick up and transfer roller.

8. The device according to claim 2, wherein the temporary support means comprise a plate which is mobile along the surface parallel with the sheets stacked, driven by means, between a non-operating position, in which the plate is distanced from the mouth of the channel, and a position in which the plate is at the mouth of the channel, at least when the partial support element is in the release position, forming a surface for the temporary support and separation of the stack of sheets being formed from a stack previously formed.

9. The device according to claim 8, wherein the plate consists of a first, operating portion which exits a slit in the channel when it reaches the operating position, and a second portion for connection to the drive means; the first, operating portion and the slit being shorter than the sheets.

10. The device according to claim 2, where the roller consists of a hub which rotates about an axis and has a plurality of first radial plates designed to pick up a single sheet and transfer it to the mouth of the channel in conjunction with a fixed wall which makes contact with one end of the sheet, and wherein the partial support element comprises a plurality of second plates forming a fork and designed to engage with the first plates of the roller, at least when the element is in the operating separation position, and in which the free end of the second plates substantially coincides with the fixed contact wall; the second plates being beak-shaped so that, at least from the operating separation position to the point at which the element exits the dimensions of the roller, they are inserted in the gap between two consecutive first plates, allowing partial support of the sheets of a stack to be formed.

11. The device according to claim 2, wherein the partial support element comprises a fork-shaped portion consisting of the second plates in the form of a single body with a fixed end support, the latter being attached to a support connected to the drive means synchronized with the roller.

12. The device according to claim 3, wherein the partial support element comprises a fork-shaped portion consisting of the second plates in the form of a single body with a fixed end support, the latter being attached to a support connected to the drive means synchronized with the roller.

13. The device according to claim 4, wherein the partial support element drive means comprise a pair of chains, each looped over pairs of toothed wheels and parallel with one another, forming a kind of four-bar linkage, and close to the channel; at least one pair of links in the pair of chains being attached to the shaft, parallel with the stacking axis, allowing a cyclical loop path for the partial support element, in time with the roller and respectively divided into a first, operation part, along an axis set at an angle to the stacking position and the release position, and a second, non-operating part, opposite to the previous one and substantially outside the dimensions of the channel and the roller.

14. The device according to claim 4, wherein the partial support element drive means comprise cam means designed to allow a cyclical looped path for the partial support element, comprising said operating separation position and release position.

15. The device according to claim 14, wherein the cam means comprise a connecting rod unit consisting of a first cam element, which is attached to the partial support element, is mobile on a first circular path and is attached to one end of the shaft forming part of the partial support element; the opposite end of the shaft being controlled by a second cam element driven by cam means synchronized with the pick up and transfer roller.

16. An apparatus for forming groups of sheets, said apparatus comprising:

a stacking channel wherein sheets are placed one on top of another in stacks;

a track that feeds individual sheets that are to be stacked in the stacking channel;

a roller that picks up the individual sheets from the track and that moves the individual sheets toward said stacking channel; and, a separating device for receiving individual sheets from the roller and delivering the individual sheets to the stacking channel, said separating device comprising a sheet support element that moves between: (i) a separation position in which the support element is located at least partially inside the dimension of the roller and intercepts sheets carried by said roller; and, (ii) a release position in which the support element is located outside the dimensions of the roller and positioned adjacent a mouth of the stacking channel, said support element at least partially supporting a stack of individual sheets received from the roller when said support element is located in said release position.

17. The apparatus as set forth in claim 16, further comprising:

temporary support means located close to the mouth of the channel, said temporary support means being mobile along a surface parallel with the sheets stacked in the channel and operating at least when the sheet support element is in the release position.

18. The apparatus as set forth in claim 16, wherein said roller comprises:

a hub that rotates about an axis;

a plurality of first radial plates connected to said hub and adapted to pick up respective single sheets and transfer said respective single sheets to the mouth of the channel, said apparatus further comprising:

a fixed wall located within the roller dimensions that makes contact with sheets carried by said radial plates of said roller, wherein said sheet support element comprises a plurality of second plates that form a fork that engages with the first radial plates of the roller when said sheet support element is said separation position, said second plates having respective free ends that substantially coincide in location to the fixed wall when said sheet support element is in said separation position, said second plates each defining a beak-shape so that said second plates are inserted in gaps defined between two consecutive first plates when said sheet support element is in said separation position.

* * * * *

UNITED STATES PATENT AND TRADEMARK OFFICE

CERTIFICATE OF CORRECTION

PATENT NO. : 6,581,927 B2
DATED : June 24, 2003
INVENTOR(S) : Claudio Rossi

It is certified that error appears in the above-identified patent and that said Letters Patent is hereby corrected as shown below:

Title page,
Item [12], should read as follows: -- Rossi --; and
Item [75], Inventor, should read as follows: -- Claudio Rossi --.

Signed and Sealed this

Eleventh Day of May, 2004

JON W. DUDAS
*Acting Director of the United States Patent and Trademark Office*